United States Patent [19]

Silli

[11] Patent Number: 5,032,141

[45] Date of Patent: Jul. 16, 1991

[54] CHANGING COLORING TREATMENT FOR WOOLEN AND MIXED WOOL CLOTHING PIECES

[75] Inventor: Alessandro Silli, Prato, Italy

[73] Assignee: R. Silli, S.p.A., Florence, Italy

[21] Appl. No.: 506,777

[22] Filed: Apr. 10, 1990

[51] Int. Cl.[5] ..... D06P 3/14; D06P 3/82

[52] U.S. Cl. ..... 8/533; 8/529; 8/917

[58] Field of Search ..... 8/533, 529, 917

[56] References Cited

FOREIGN PATENT DOCUMENTS 0315725 5/1989 European Pat. Off. .
0211178 2/1924 United Kingdom .
1124344 8/1968 United Kingdom .

*Primary Examiner*—Paul Lieberman
*Assistant Examiner*—William S. Parks
*Attorney, Agent, or Firm*—McAulay Fisher Nissen Goldberg & Kiel

[57] ABSTRACT

Method of producing a shot effect in dyed woollen fabrics and items of clothing, using a dyeing method having the following stages: (a) dyeing the products in a rotary vat in a bath of water to which are added, in successive steps and at different, increasing temperatures, firstly a size or glue and secondly a colorant diluted with a dispersing agent, and then cooling the dye bath, draining the dye bath from the dyeing vat, and rinsing the dyed product; (b) placing the product in clean water for a second bath, with the dyeing vat in motion and adding to the second bath in successive steps an elastomer and a catalyst which creates a pH of between 2 and 3 in the bath and activates the elastomer, thus fixing the dye to the body of the product fibers and not to the surface filaments of the fibers, and finally draining the second bath from the dyeing vat, rinsing and drying the dyed products.

8 Claims, No Drawings

CHANGING COLORING TREATMENT FOR WOOLEN AND MIXED WOOL CLOTHING PIECES

BACKGROUND OF THE INVENTION

1. Field of the Invention

This invention relates to a coloring treatment for clothing items.

2. Description of the Prior Art

As is well known, clothing is made from wool as well as items containing wool and other materials such as rayon and polyester.

SUMMARY OF THE INVENTION

The invention is more particularly concerned with a coloring treatment for clothing pieces in wool and mixed wool which, as a principle, provides for a mantle or outer garment having as a characteristic thereof to impart to a viewer a changing sight perception that is determined by a brilliant emerging part on an opaque coloring background. The coloring effect carries out a new conception of a mantle and is characterized by continuous changes in accordance with observations made by a person observing the outer garment from different observation angles. This is due to a depth coloring effect and by the hue of the part from which dye has been removed. The depth coloring effect causes a viewing effect according to the angle of observation of the part.

The treatment according to the invention produces a sight perception of a soft mantle which gets a varying brilliancy of tones on the coloring bottom. The tonal changes determined by the two parts, if closely observed, give rise to reflection effects of the light rays which produce brightness effects, and increases the incidence angle, in the perception of the deep coloring with the absorption of the light rays through the presence of the emerging part which acts as a filter. A particular sight and tactile preciousness of the material thus turns out which opens a new canal in the wool and mixed wool dressing sector.

An essential characteristic feature of the treatment, in a preliminary way, consists of carrying out a dyeing operation of the dressing piece without fixing it in order to then cause the pigmentation spray on the mantel bottom, whereas the surface part takes again the original dye and, in particular, a dyeing tending to a neutral one.

To these ends, the invention consists in the provision of a method for coloring treatment of material, comprising the steps of placing the material to be treated into a dyeing tank, adding a bath comprising clean water and glue to the material in the dyeing tank, adding a dye to the clean water and glue in the dyeing tank to provide a dyeing bath, adding a non-fixed hue to the material in the bath, and then cooling the bath, rinsing the material in a rinsing solution by placing the material into a solution comprising clear water and an added elastomer, adding a catalyzer to fix the dye to the material, and then rinsing the material and then centrifuging thereof.

The material is preferably dyed without fixing the dye therein prior to placement of the material into the dyeing tank.

In a specific embodiment, forty (40) liters of clean water is added to the dyeing tank for each one (1) Kg of material and ten (10) percent of the glue, and then the dyeing tank is rotated for thirty minutes at a temperature of fifty degrees centigrade.

During a second phase in which the pigment is added, the dyeing bath is cooled down to fifty degrees centigrade.

DESCRIPTION OF THE PREFERRED EMBODIMENTS

Substantially, in carrying out a treatment, the material is laid or placed into a dyeing tank with clean water and glue and with the addition of a pigment diluted with a dispersing product. After having carried out a not-fixed hue of the pieces, the bath is cooled down, the dyed material is rinsed and put again into clean water with the addition of an elastomer which acts as a dyeing binder. Some catalyzer is then added for fixing; then, the piece is rinsed and centrifugated. As a final step, the material is dried and rinsed with the addition of softener.

The treatment causes the sedimentation of the very fine pigment dust on the bottom of the mantle piece or clothing bottom, carrying out a deep opaque coloring. The coloring gives a particular surface brilliancy to the emerging part of the mantle from which fine dust has been removed.

During the treatment, a first operation phase provides for a dyeing of the material without fixing the piece of material, which is at first dry-washed and then put into the dyeing tank with clean water at the rate of 1 to 40 (40 liters of water and 1 Kg. of material), by adding a 10% of a gluey product, and rotating the dyeing tank unit for a period of 30 minutes at a temperature of approximately 50° C. to impart a mixing action.

Dye is then added which consists of a pigment diluted with a dispersing product, and the machine or dyeing tank is then turned or rotated for a period of sixty (60) minutes at a temperature of approximately 95° C. In the second phase, the dyeing bath is cooled down to a temperature of 50° C., and the dyed material is rinsed. This one is again put into clean water with an added elastomer, such as a polyvinyl resin which acts as a dyeing binder, at a 10% rate. A 1% catalyzer is now added to fix the resin, and the unit goes on and is rotated with its cold temperature and movement for a period of 30 minutes. The material is then rinsed, centrifugated, and the piece is wholly dried at a temperature of 140° C. Then, the piece is again rinsed in clean water with the addition of a softener in order to obtain a finished piece with a softer mantle.

The treatment can be carried out on finished pieces, on working ones, as well as on material at the origin.

The execution particulars, the integrators and anything else in this connection may be used in different ways according to the intended use or requirements.

DESCRIPTION OF OPERATION

The treatment method for changing the coloring for woollen and mixed clothing pieces comprises two operational phases.

A first operational phase for carrying out a dyeing without fixing the piece includes a first dry-washing and then placement of the material into a dyeing tank with clean water at a rate of 1 to 40, with the addition of a 10% of a glueing product while rotating the unit for a period of 30 minutes at a temperature of 50° C.; and then adding a dyeing material consisting of a pigment diluted with a dispersing product, and rotating the machine for another 60 minutes at a temperature of 98° C.

The second operational phase includes cooling the dyeing bath down to 50° C., and then rinsing the material; rinsing the material and then centrifugating it and thoroughly drying the material at 140° C.; and finally subjecting the material to a final rinse in clean water with the addition of a softener to produce a soft finished piece.

The dye comprises a pigment diluted with a dispersing product.

While there has been disclosed what has been considered to be the preferred embodiments of the invention, various changes and modifications may be made therein without departing from the scope of the invention.

I claim:

1. A method for dyeing textile products, comprising:

(a) treating the products by dyeing the products in a bath of water in a dyeing vat, with the dyeing vat in motion; adding to the bath in successive steps firstly a glue and secondly a colorant diluted in a dispersing agent; heating the vat to approximately 95° C. in successive steps and rotating the vat for approximately 60 minutes at the aforesaid temperature; cooling the vat to approximately 50° C., with the vat rotating; and draining the vat of said bath and rinsing the treated products; and (b) placing the treated products into a second bath of water in the vat, with the vat in motion and at ambient temperature, adding to the bath firstly an elastomer and then a catalyst to create a pH of between 2 and 3 in the dye bath, thus activating the elastomer; said elastomer being added to the water at the beginning of the second bath and said catalyst being added after a defined time; said dyeing vat being allowed to continue rotating long enough to fix the colorant to the product fibers; and finally, draining the bath from the vat, and drying the products.

2. The method of claim 1, including the step of rinsing the textile products.

3. The dyeing method of claim 1, wherein the elastomer is a polyvinyl resin.

4. The dyeing method of claim 2, wherein the elastomer is a polyvinyl resin.

5. A method of dyeing shot woollen fabrics and items of clothing which may be implemented using a rotary dyeing tank, colorants and bonding agents to fix the colorants to the fibers of the products to be dyed, the method comprising a first operational phase for carrying out a dyeing and a second operational phase for finishing the method;

said first operational phase comprising:

(a) dyeing the products in a vat having a bath of water in a ratio of 40 liters of water to every 1 kg of product;

(b) adding to the bath of water in said vat in successive steps firstly a gluing product in a ratio of 10% to the weight of the products to be dyed;

(c) heating the vat to a temperature of approximately 50° C. and rotating the vat for approximately 30 minutes;

(d) adding a colorant diluted in a dispersing agent in a proportion of 10% of the amount of colorant used; and (e) heating the vat to approximately 95° C. and rotating the vat for approximately a further 60 minutes; and (f) cooling the vat to approximately 50° C. while rotating the vat, then draining the vat of the aforesaid bath and rinsing the treated products;

(g) placing the treated products into a dye bath of clean water in a dyeing vat and, with the vat being rotated, adding to the bath an elastomer in the proportion of 10% of the amount of water used, and allowing the vat to rotate at ambient temperature for approximately 15 minutes;

(h) subsequently activating the elastomer by adding a catalyst to the dye bath in a proportion of approximately 1% of the amount of water used, and in a proportion sufficient to create a pH of between 2 and 3 in the dye bath, and rotating the dyeing vat for a further 30 minutes; and (i) draining the vat of the dye bath and finally drying the dyed products.

6. The dyeing method of claim 5, including in step (i) rinsing the dyed products prior to drying thereof.

7. The dyeing method of claim 5, wherein the elastomer is a polyvinyl resin.

8. The dyeing method of claim 6, wherein the elastomer is a polyvinyl resin.

* * * * *